US008015017B2

(12) United States Patent
Sung et al.

(10) Patent No.: US 8,015,017 B2
(45) Date of Patent: Sep. 6, 2011

(54) BAND BASED AUDIO CODING AND DECODING APPARATUSES, METHODS, AND RECORDING MEDIA FOR SCALABILITY

(75) Inventors: Hosang Sung, Yongin-si (KR); Rakesh Taori, Suwon-si (KR); Kangeun Lee, Gangneung-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1312 days.

(21) Appl. No.: 11/337,487

(22) Filed: Jan. 24, 2006

(65) Prior Publication Data

US 2006/0217975 A1 Sep. 28, 2006

(30) Foreign Application Priority Data

Mar. 24, 2005 (KR) ..... 10-2005-0024567

(51) Int. Cl.
*G10L 19/00* (2006.01)

(52) U.S. Cl. ..... 704/500; 704/201; 704/206; 704/228; 704/501; 704/E19.01

(58) Field of Classification Search ..... 704/228, 704/500, 201, 206, 501, E19.01
See application file for complete search history.

(56) References Cited

U.S. PATENT DOCUMENTS 5,717,764 A * 2/1998 Johnston et al. ..... 381/2
5,864,813 A * 1/1999 Case ..... 704/500
6,122,618 A * 9/2000 Park ..... 704/500
6,349,284 B1 * 2/2002 Park et al. ..... 704/500
6,584,442 B1 * 6/2003 Suzuki et al. ..... 704/500
6,704,711 B2 * 3/2004 Gustafsson et al. ..... 704/258
6,772,114 B1 * 8/2004 Sluijter et al. ..... 704/220
7,328,162 B2 * 2/2008 Liljeryd et al. ..... 704/503
7,406,410 B2 * 7/2008 Kikuiri et al. ..... 704/221
7,835,904 B2 * 11/2010 Li et al. ..... 704/200.1
2001/0023396 A1 * 9/2001 Gersho et al. ..... 704/220
2001/0036321 A1 * 11/2001 Kishi ..... 382/240
2003/0045953 A1 * 3/2003 Weare ..... 700/94
2003/0061055 A1 * 3/2003 Taori et al. ..... 704/500
2003/0154074 A1 * 8/2003 Kikuiri et al. ..... 704/219
2003/0171920 A1 * 9/2003 Zhou et al. ..... 704/230
2004/0024594 A1 * 2/2004 Lee et al. ..... 704/219
2005/0163323 A1 * 7/2005 Oshikiri ..... 381/22
2007/0274383 A1 * 11/2007 Yu et al. ..... 375/240.11

OTHER PUBLICATIONS

B. Kövesi, D. Massaloux and A. Sollaud, "A scalable speech and audio coding scheme with continuous bitrate flexibility", ICASSP2004, Montréal, May 2004.*
H. Pumhagen, "Advances in parametric audio coding", in Pmc. WASPAA, Oct. 1999.*

(Continued)

*Primary Examiner* — Richemond Dorvil
*Assistant Examiner* — Greg Borsetti
(74) *Attorney, Agent, or Firm* — Staas & Halsey LLP

(57) ABSTRACT

Audio coding and decoding apparatuses and methods which support fine granularity scalability (FGS) using harmonic information of a high-band audio signal or wideband error audio signal when performing wideband audio coding and decoding, and recording mediums on which the methods are stored. The audio coding method includes detecting harmonics of a high-band audio signal or wideband error audio signal of an input audio signal; determining an order of the detected harmonics; and coding the detected harmonics based on the determined order.

29 Claims, 9 Drawing Sheets

OTHER PUBLICATIONS

H. Pnmhagen and N. Meine, HILN—The MPEG-4 Parametric Audio Coding Tools: Pmc. IEEE ISCAS 2000, May 2000.*

H. Purnhagen, "An Overview of MPEG-4 Audio Version 2," Proc. AES 17th International Conference, Sep. 1999.*

A. McCree, "A 14 kb/s Wideband Speech Coder with a Parametric Highband Model," in Proc. IEEE Int. Conj Acousr., Speech, Signal Processing, Istanbul, 2000, pp. 1153-1 156.*

H. Purnhagen, N. Meine, and B. Edler, "Speeding up HILN—MPEG-4 Parametric Audio Encoding with Reduced Complexity," AES 109th Convention, Preprint 5177, Los Angeles, Sep. 2000.*

D. L. Thomson, "Parametric models of the magnitude/phase spectrum for harmonic speech coding," Proc. IEEE ICASSP, 1988.*

Dietz, L. Liljeryd, K. Kjörling and O. Kunz, "Spectral Band Replication, a novel approach in audio coding", Preprint 5553, 112th AES Convention, Munich (D), May 10-13, 2002.*

Park et al. "Multi. Layer Bit-Sliced Bit-Rate Scalable Audio Coding" 1997.*

Yu et al. "MPEG-4 Scalable to Lossless Audio Coding" Oct. 2004.*

Schulz et al. "Improving Audio Codecsby Noise Substitution" 1996.*

Wolters et al. "A closer look into MPEG-4 High Efficiency AAC" Oct. 2003.*

Kim et al. "Fine grain scalability in MPEG-4 Audio" 2001.*

Kim et al. "Scalable Lossless Audio Coding Based on MPEG-4 BSAC" 2002.*

* cited by examiner

BAND BASED AUDIO CODING AND DECODING APPARATUSES, METHODS, AND RECORDING MEDIA FOR SCALABILITY

CROSS-REFERENCE TO RELATED APPLICATION

This application claims the benefit of Korean Patent Application No. 10-2005-0024567, filed on Mar. 24, 2005, in the Korean Intellectual Property Office, the disclosure of which incorporated herein in its entirety by reference.

BACKGROUND OF THE INVENTION

1. Field of the Invention

The present invention relates to audio coding and decoding apparatuses and methods, and recording media storing the methods, and more particularly, to audio coding and decoding apparatuses and methods which support fine granularity scalability (FGS) using harmonic information of a high-band audio signal or wideband error audio signal when performing wideband audio coding and decoding, and a recording media storing the methods.

2. Description of Related Art

As the range of applications of audio communications and the transmission speed of networks have increased, the demand for high-quality audio communications has also increased. As such, while a conventional audio communication band is 0.3-3.4 kHz, a transmission of a wideband audio signal having a bandwidth of 0.3-7 kHz with high performance in a variety of aspects such as, for example, a natural property and clarity is needed.

In addition, a packet switching network via which data is transmitted in packet units may cause congestion of a channel and packet loss and audio degradation may occur. To solve this problem, a method of concealing a damaged packet has been used but this cannot be a fundamental solution.

Thus, a wideband audio coding and decoding method in which congestion of a channel is prevented by effectively compressing the wideband audio signal has been proposed.

Three examples of wideband audio coding and decoding methods include a first wideband audio coding and decoding method in which an audio signal having a bandwidth of 0.3-7 kHz is compressed at one time and restored, a second wideband audio coding and decoding method in which an audio signal having a bandwidth of 0.3-4 kHz and an audio signal having a bandwidth of 4-7 kHz are compressed hierarchically and restored, and a third wideband audio coding and decoding method in which an audio signal having a bandwidth of 0.3-3.4 kHz is compressed, restored and up-sampled to a wideband signal and a wideband error signal between an original wideband audio signal and the up-sampled wideband signal is obtained and compressed.

The second and third wideband audio coding and decoding methods use bandwidth scalability that enables optimum communication in a channel environment obtained by adjusting the amount of data of a layer to be transmitted according to the degree of congestion.

In the second and third wideband audio coding and decoding methods using the bandwidth scalability, a high-band audio signal having a frequency band of 4-7 kHz is coded using a modulated lapped transform (MLT). A high-band audio signal coding apparatus using a MLT is as shown in FIG. 1.

Referring to FIG. 1, if a high-band audio signal is inputted to the high-band audio signal coding apparatus, the high-band audio coding apparatus performs an MLT on the high-band audio signal inputted to an MLT unit 101 and extracts an MLT coefficient. The magnitude of the extracted MLT coefficient is outputted to a 2 dimensional discrete cosine transform (2D-DCT) module 102, and the sign of the extracted MLT coefficient is outputted to a sign quantizer 103.

The 2D-DCT module 102 extracts a 2D-DCT coefficient from the magnitude of an inputted MLT coefficient and outputs the extracted 2D-DCT coefficient to a DCT coefficient quantizer 104. The DCT coefficient quantizer 104 arranges 2D-DCT vector coefficients in an ascending series statistically, quantizes the arranged vectors and then outputs codebook indices of the arranged vectors. The sign quantizer 103 quantizes a sign of a large MLT coefficient and outputs the quantized sign. The outputted codebook indices and the quantized sign are provided to a high-band audio decoding apparatus (not shown).

However, in high-band audio signal coding using the MLT, it is difficult to restore a high-quality audio signal when an audio signal is transmitted at a low bit rate.

In order to solve this problem, a high-band audio coding apparatus using a harmonic coder shown in FIG. 2 has been proposed.

Referring to FIG. 2, a harmonic peak detector 201 detects a harmonic peak of the inputted high-band audio signal and outputs an amplitude and a phase of the high-band audio signal based on the detected harmonic peak.

An amplitude quantizer 202 quantizes the amplitude of the inputted high-band audio signal and outputs a high-band audio signal having the quantized amplitude. A phase quantizer 203 quantizes phase of the inputted high-band audio signal and outputs a high-band audio signal having the quantized phase. The quantized amplitude and the quantized phase are provided to a high-band audio decoding apparatus (not shown).

A high-quality signal can be reproduced at a low bit rate with low complexity through high-band audio signal coding using the harmonic coder shown in FIG. 2. However, there is a limited support of scalability for the inputted high-band audio signal.

In addition, when performing wideband error audio coding using the third method having the bandwidth scalability function, a wideband error audio signal having a bandwidth of 0.05-7 kHz is coded using a modified discrete cosine transform (MDCT). Awideband error audio signal coding apparatus using an MDCT shown in FIG. 3.

Referring to FIG. 3, if a wideband audio signal is inputted to the wideband error audio coding apparatus, the wideband error audio coding apparatus obtains a signal down-sampled to a low band using a down-sampling module 301 and codes the signal down-sampled to the low band using a low-band audio coder 302. The coded audio signal is restored to a wideband signal using an up-sampling module 303, and the restored wideband signal is subtracted from the inputted wideband audio signal by a subtracter 304 to generate a wideband error audio signal. The generated wideband error audio signal is inputted to an MDCT unit 305, and the MDCT unit 305 extracts an MDCT coefficient of the inputted wideband error audio signal. The extracted MDCT coefficient is divided into bands by a bandwidth dividing module 306, and the divided MDCT coefficient is normalized by a normalization module 307. The normalized MDCT coefficient is quantized by the quantizer 308, and the quantizer 308 outputs codebook indices. The outputted codebook indices are provided to a high-band audio decoding apparatus (not shown).

However, when an audio signal is transmitted at a low bit rate when using the wideband error audio signal coding method with the MDCT, it is difficult to restore a high-quality audio signal.

BRIEF SUMMARY

An aspect of the present invention provides audio coding and decoding apparatuses and methods which support fine granularity scalability (FGS) using harmonic information of a high-band audio signal or wideband error audio signal during wideband audio coding and decoding, and recording mediums storing the methods.

An aspect of the present invention also provides audio coding and decoding apparatuses and methods in which a high-band audio signal or wideband error audio signal is coded and decoded in harmonic units during wideband audio coding and decoding and which supports sufficient scalability for an audio signal, and recording mediums storing the methods.

According to an aspect of the present invention, there is provided an audio coding method including: detecting harmonics of a high-band audio signal or wideband error audio signal of an inputted audio signal; determining an order of the detected harmonics; and coding the harmonics based on the determined order of the harmonics.

According to another aspect of the present invention, there is provided an audio coding apparatus including: a harmonic detecting unit detecting harmonics of a high-band audio signal or wideband error audio signal of an inputted audio signal; a harmonic order determining unit determining an order of the detected harmonics; and a harmonic coding unit decoding the harmonics based on the determined order of the harmonics.

According to another aspect of the present invention, there is provide an audio decoding method including: decoding a received bitstream corresponding to a coded high-band audio signal or wideband error audio signal for each layer; and outputting the decoded result for each layer as a high-band audio signal or wideband error audio signal restored in each layer.

According to another aspect of the present invention, there is provided an audio decoding apparatus including: a bit unpacking unit, which if a bitstream corresponding to a coded high-band audio signal or wideband error audio signal is received, unpacks and outputs the received bitstream; and a harmonic decoding unit which decodes the bitstream outputted in each layer from the bit packing unit in layer units.

According to another aspect of the present invention, there is provided a recording medium on which a program for performing an audio coding method is recorded, the audio coding method including: detecting harmonics of a high-band audio signal or wideband error audio signal of an inputted audio signal; determining an order of the detected harmonics; and coding the harmonics based on the determined order of the harmonics.

According to another aspect of the present invention, there is provided a recording medium on which a program for performing an audio decoding method is recorded, the audio decoding method including: decoding a received bitstream corresponding to a coded high-band audio signal or wideband error audio signal for each layer; and outputting the decoded result for each layer as a high-band audio signal or wideband error audio signal restored of each layer.

Additional and/or other aspects and advantages of the present invention will be set forth in part in the description which follows and, in part, will be obvious from the description, or may be learned by practice of the invention

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1:
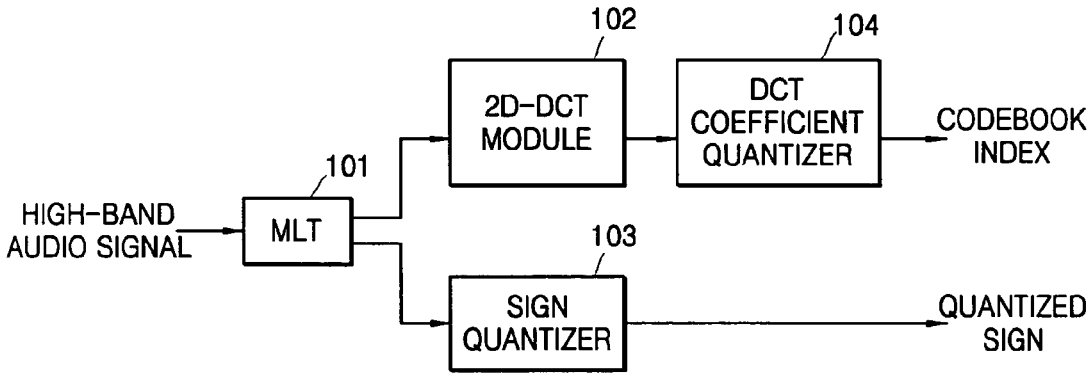
FIG. 1 (PRIOR ART)
FIG. 1 is a functional block diagram of a conventional high-band audio coding apparatus.
Figure 2:
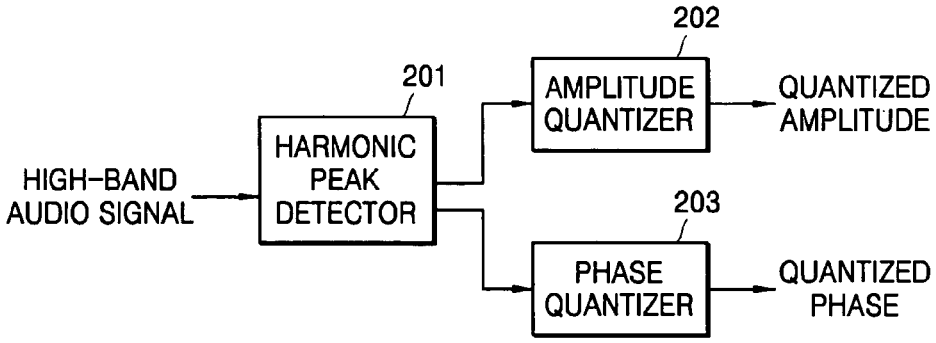
FIG. 2 (PRIOR ART)
FIG. 2 is a functional block diagram of another conventional high-band audio coding apparatus.
Figure 3:
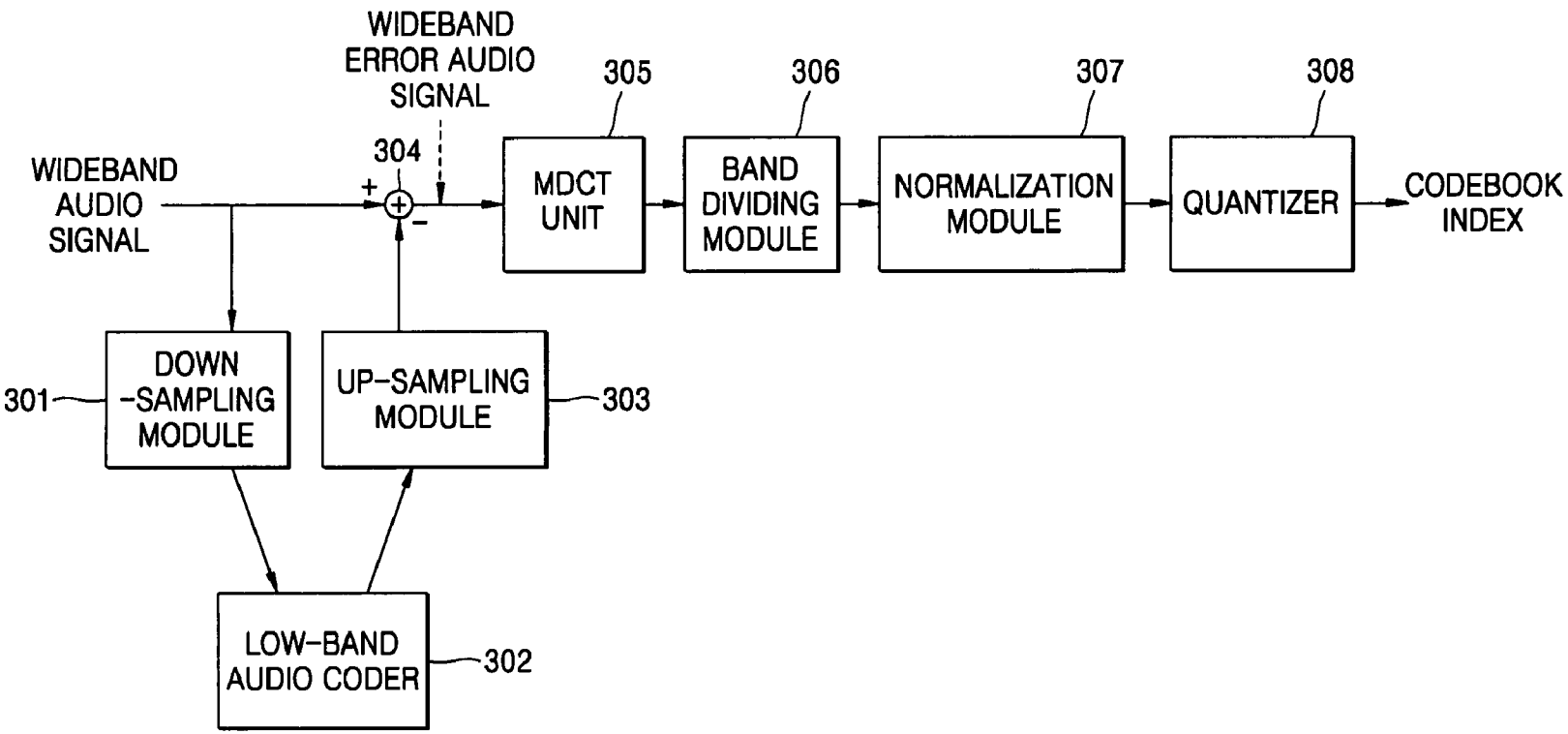
FIG. 3 (PRIOR ART)
FIG. 3 is a functional block diagram of a conventional wideband error audio coding apparatus.

Reference will now be made in detail to embodiments of the present invention, examples of which are illustrated in the accompanying drawings, wherein like reference numerals refer to the like elements throughout. The embodiments are described below in order to explain the present invention by referring to the figures.

Figure 4:
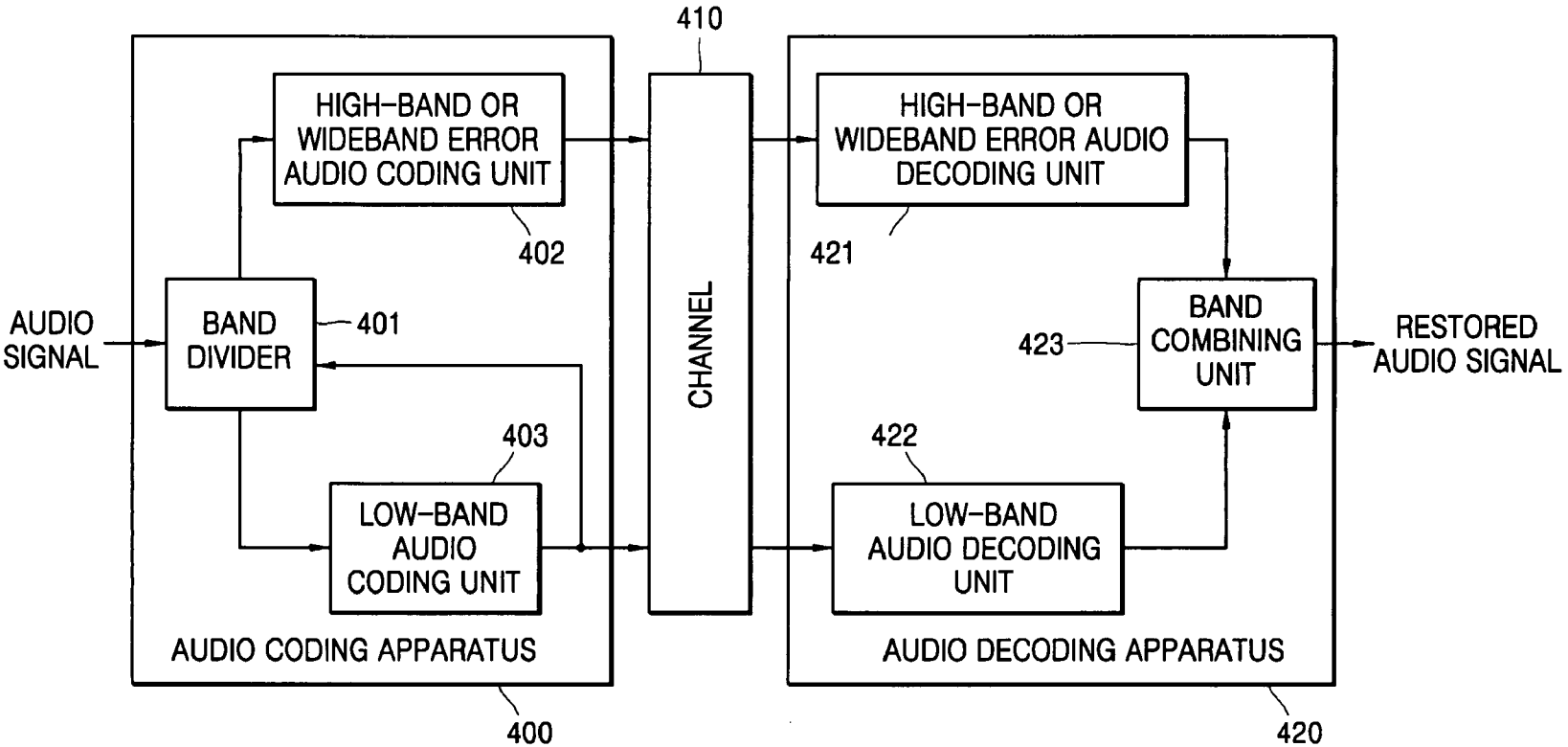
FIG. 4 is a functional block diagram of a wideband audio system including a high-band or wideband error audio coding and decoding apparatus according to an embodiment of the present invention.

FIG. 4 is a functional block diagram of a wideband audio system including a high-band or wideband error audio coding and decoding apparatuses (respectively 402 and 421) according to an embodiment of the present invention. Referring to FIG. 4, the wideband audio system includes an audio coding apparatus 400, a channel 410, and an audio decoding apparatus 420.

The audio coding apparatus 400 includes a band divider 401, the high-band or wideband error audio coding unit 402, and a low-band audio coding unit 403.

If an audio signal is inputted to the audio coding apparatus 400, the band divider 401 divides the inputted audio signal into a low-band audio signal and a high-band audio signal and outputs the low-band and high-band audio signals or divides the inputted audio signal into a wideband error audio signal obtained by subtracting a signal obtained by decoding a low-band audio signal outputted from the low-band audio coding unit 403, from the inputted audio signal and the low-band audio signal, and outputs the low-band and the wideband error audio signal.

The high-band or wideband error audio coding unit 402 codes a high-band audio signal or wideband error audio signal so as to support fine granularity scalability (FGS) using harmonic information of the high-band audio signal or wideband error audio signal outputted from the band divider 401.

Figure 5:
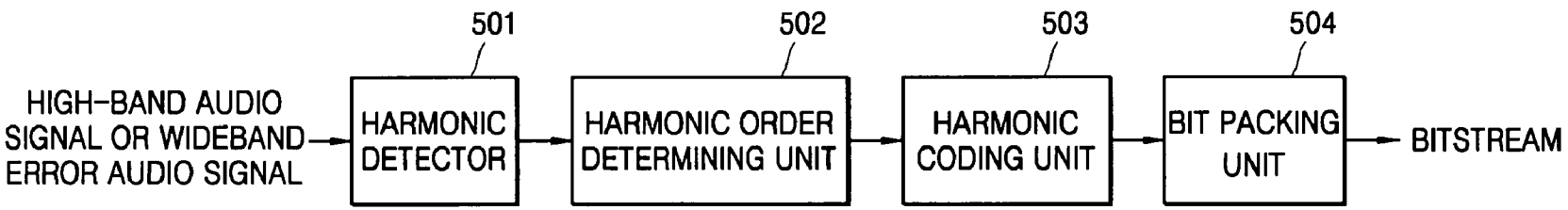
FIG. 5 is a functional block diagram of the high-band or wideband error audio coding apparatus shown in FIG. 4.

FIG. 5 is a block diagram of the high-band or wideband error audio coding unit 402. Referring to FIG. 5, the high-band or wideband error audio coding unit 402 includes a harmonic detector 501, a harmonic order determining unit 502, a harmonic coding unit 503, and a bit packing unit 504.

The harmonic detector 501 detects harmonics of the inputted high-band audio signal or wideband error audio signal. That is, the harmonic detector 501 detects all of the harmonics of the inputted high-band or wideband error audio signal using matching pursuit (MP) or fast Fourier transform (FFT). In this case, the number of detectable harmonics may be set in consideration of a transmission rate of a codec, sound quality, complexity, etc. For example, in the case of a high-band audio signal, the number of detectable harmonics can be set to 60, and in the case of a wideband error audio signal, the number of detectable harmonics can be set to 120, and the number of detectable harmonics can be variably set according to a sampling method of an inputted signal.

In a harmonic-detecting method using FFT, an inputted high-band audio signal or wideband error audio signal is FFTed and then, a peak corresponding to each harmonic is searched for, and the magnitude and phase of each harmonic are detected. In a harmonic-detecting method using MP, harmonics of an inputted high-band audio signal or wideband error audio signal are analyzed using a pitch lag (or a pitch delay) obtained from the high-band audio signal or wideband error audio signal. That is, a fundamental frequency $\omega_0$ is searched for using the pitch lag and harmonic parameters are searched for using a sine dictionary. The harmonic parameters include an amplitude A and a phase $\phi$.

The amplitude A and phase $\phi$ of the sine dictionary are searched for using a matching pursuit (MP) algorithm in which an audio signal s(n) is used as a target signal. An audio signal $S_H(n)$ indicated by the sine dictionary can be defined using Equation 1.

$$s_H(n) = w_{ham}(n)\sum_{k=0}^{K-1} A_k \cos(\omega_k n + \phi_k), \tag{1}$$

where $A_k$ is the amplitude of a k-th sine wave, $\omega_k$ is an angle frequency of the k-th sine wave, $\phi_k$ is the phase of the k-th sine wave, $w_{ham}(n)$ is a hamming window, and K is the number of sine dictionaries.

If all of the detectable harmonics are detected in frame units, the harmonic detector 501 can restrict the number of detected harmonics using a smoothing method by which weak harmonics, that is, detected harmonics having values less than or equal to a predetermined value, are removed. In the smoothing method, harmonics are removed if the ratio of magnitudes of adjacent harmonics is smaller than or equal to a predetermined value. The predetermined value is set according to a transmission rate of a codec and sound quality, etc. The ratio is obtained by setting a harmonic having a larger value of the two harmonics to a denominator and a harmonic having a smaller value of the two harmonics to a numerator.

Figure 6:
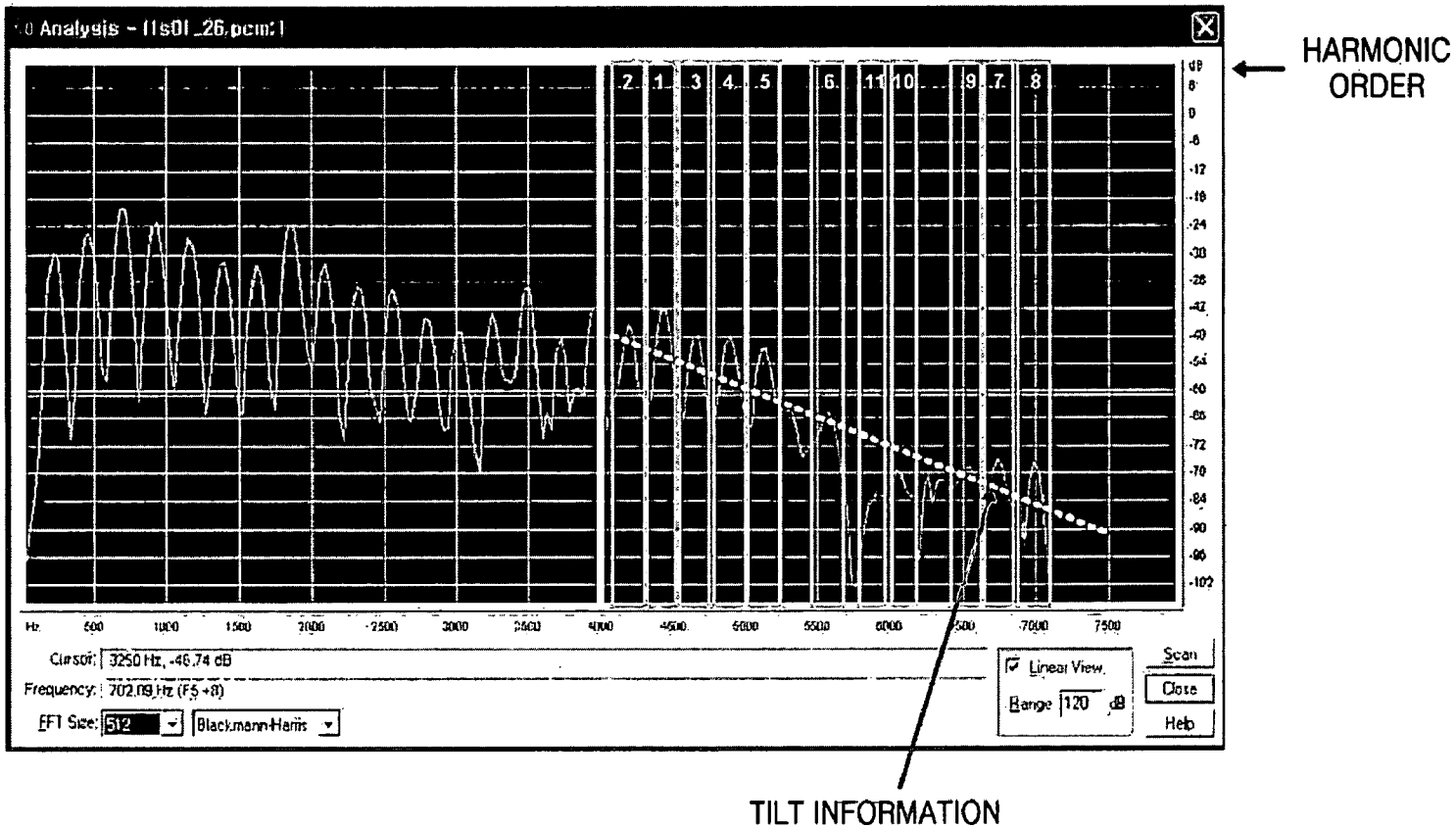
FIG. 6 is an exemplary waveform diagram of harmonics of a high-band audio signal or wideband error audio signal detected according to an embodiment of the present invention.

The harmonic detector 501 obtains information required for noise filling. The information required for noise filling includes a root mean square (RMS) of magnitudes of harmonics detected in a frame where harmonics detection is performed and tilt information of a spectrum. The tilt information is gradient information as indicated in FIG. 6 and defined using a function smaller than or equal to a quadratic function.

The harmonic order determining unit 502 determines the ordering of harmonics detected by the harmonic detector 501. To this end, the harmonic order determining unit 502 uses perceptual weighting for the detected harmonics. That is, the harmonic order determining unit 502 detects the magnitude, the phase, and band information for each harmonic. The harmonic order determining unit 502 normalizes the detected magnitude, phase, and band information.

The magnitudes of harmonics are normalized based on the largest amplitude. The bands of harmonics are normalized by setting the lowest band to 1 and the highest band to 0 in an inputted audio signal and interpolating the other bands within the numerical range. The phases of the harmonics are normalized in the range from $-\pi$ to $\pi$ by setting an absolute value to $\pi$. In other words, $-\pi$ or $\pi$ is 1 and the other values are interpolated between 0 and 1.

The harmonic order determining unit 502 obtains an ordering criterion C by multiplying a normalized amplitude M, a normalized phase P, and normalized band information B by predetermined weighting values $W_m$, $W_p$, and $W_b$, respectively, as shown in Equation 2

$$C = MW_m + PW_p + BW_b \tag{2}$$

The weighting values $W_m$, $W_p$, and $W_b$ can be obtained using $$W_m > 2 * W_b > 4 W_p \tag{3}$$

The harmonic order determining unit 502 determines an order for the harmonics detected in each frame based on the obtained ordering criterion C of each harmonic. That is, the order of the detected harmonics can be determined as shown in FIG. 6.

The harmonic coding unit 503 codes the magnitudes and phases of the harmonics sequentially from the harmonics having the highest priorities based on the order determined by the harmonic order determining unit 502. In this case, the harmonic coding unit 503 also codes information required for noise filling.

Figure 7:
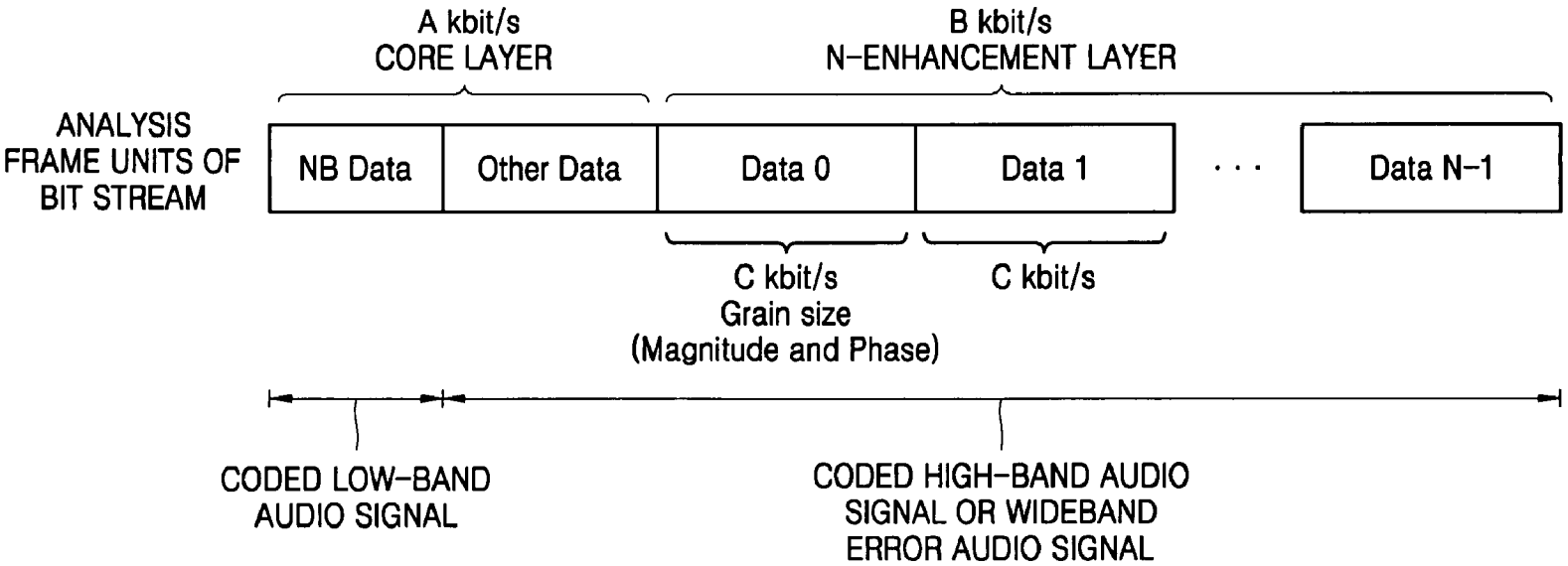
FIG. 7 shows the structure of a bitstream in frame units packed according to an embodiment of the present invention.

The bit packing unit 504 bit-packs the result of coding obtained by the harmonic coding unit 503 and generates and outputs a bitstream having a data structure shown in FIG. 7. Referring to FIG. 7, a bitstream of a high-band audio signal or wideband error audio signal is classified into a core layer and an enhancement layer. The core layer can be divided into a data field on a low-band signal and the other data field. The information required for noise filling is included in the other data field. Information about the magnitudes and phases of harmonics is included in the enhancement layer. The enhancement layer shown in FIG. 7 is a data structure that can support FGS. A total bit rate of the bitstream shown in FIG. 7 is defined by Akbit/s (core layer)+Bkbit/s (enhancement layer).

Returning to FIG. 4, the low-band audio coding unit 403 of FIG. 4 codes the low-band audio signal transmitted from the band divider 401 and outputs the bit-packed audio signal. The bit-packed audio signal outputted from the low-band audio coding unit 403 is transmitted to the channel 410 and the band divider 401.

The channel 410 transmits the bit-packed and coded bitstream outputted from the high-band audio signal or wideband error audio coding unit 402 and the low-band audio coding unit 403 to the audio decoding apparatus 420.

The audio decoding apparatus 420 receives a bitstream packet of the coded high-band or wideband error audio signal transmitted from the channel 410 and a bitstream packet of the coded low-band audio signal, respectively, and generates a restored audio signal.

To this end, the audio decoding apparatus 420 includes the high-band or wideband error audio decoding unit 421, a low-band audio decoding unit 422, and a band combining unit 423.

The high-band or wideband error audio decoding unit 421 unpacks a received bitstream packet corresponding to the coded high-band audio signal or wideband error audio signal and generates an audio signal restored in layer units and outputs the generated audio signal.

Figure 8:
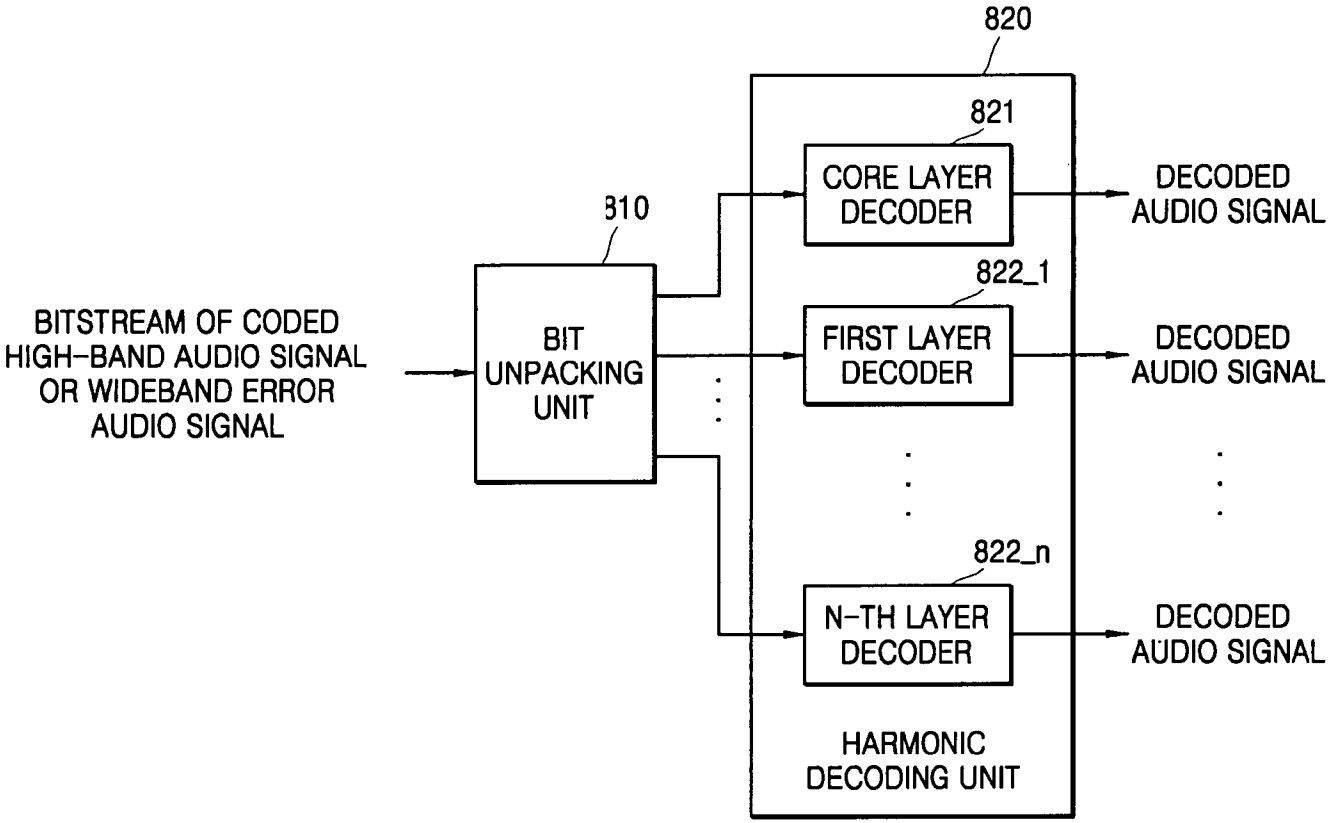
FIG. 8 is a functional block diagram of the high-band or wideband error audio decoding apparatus shown in FIG. 4.

FIG. 8 is a block diagram of the high-band or wideband error audio decoding unit 421. Referring to FIG. 8, the high-band or wideband error audio decoding unit 421 includes a bit unpacking unit 810 and a harmonic decoding unit 820.

The bit unpacking unit 810 unpacks a received bitstream including a core layer composed of other data field and an enhancement layer, as shown in FIG. 7, so that the bitstream is divided into the core layer and the enhancement layer and the enhancement layer is divided in data field units (or harmonic units) and outputs the unpacked bitstream.

The harmonic decoding unit 820 includes a core layer decoder 821 and first through n-th layer decoders 822_1 to 822_n and decodes each layer of the bitstream. That is, the core layer decoder 821 decodes the other data field of the bitstream, the first layer decoder 822_1 decodes a data field Data 0, and the n-th layer decoder 822_n decodes a data field Data N−1.

However, whether or not each of the decoders 821 and 822_1 through 822_n included in the harmonic decoding unit 820 performs decoding can be determined according to operating conditions of the audio decoding apparatus 420, a user's choice or the environment of the channel 410. If harmonic information defined in the data field Data 0 in the enhancement layer of a frame is received, an audio signal of the frame can be restored using information required for noise filling defined in the core layer.

In other words, when the number of harmonics of the corresponding frame is small, the harmonic decoding unit 820 performs noise filling. Whether or not the harmonic decoding unit 820 will perform noise filling is determined using a threshold value. The used threshold value may be set based on the ratio of the sum of magnitudes of all of the decoded harmonics to the total RMS. When the ratio is smaller than or equal to the threshold value, the harmonic decoding unit 820 performs the noise filling. In the noise filling, the restored harmonics are obtained and magnitude information about the entire band is obtained using the transmitted RMS and gradient. Next, the noise filling is performed in such a way that random noise is generated for undecoded portions and filled in the undecoded portions. In this case, magnitude information corresponding to the band is the amplitude of random noise to be generated.

Returning to FIG. 4, the high-band audio signal or wideband error audio signal decoded in each layer is transmitted to the band combining unit 423.

The low-band audio decoding unit 422 decodes a received bitstream corresponding to the coded low-band audio signal and outputs the restored low-band audio signal. The restored low-band audio signal is transmitted to the band combining unit 423.

The band combining unit 423 combines the audio signal outputted from the high-band or wideband error audio signal decoding unit 421 and restored in each layer with the restored low-band audio signal outputted from the low-band audio decoding unit 422 and outputs the restored audio signal.

Figure 9:
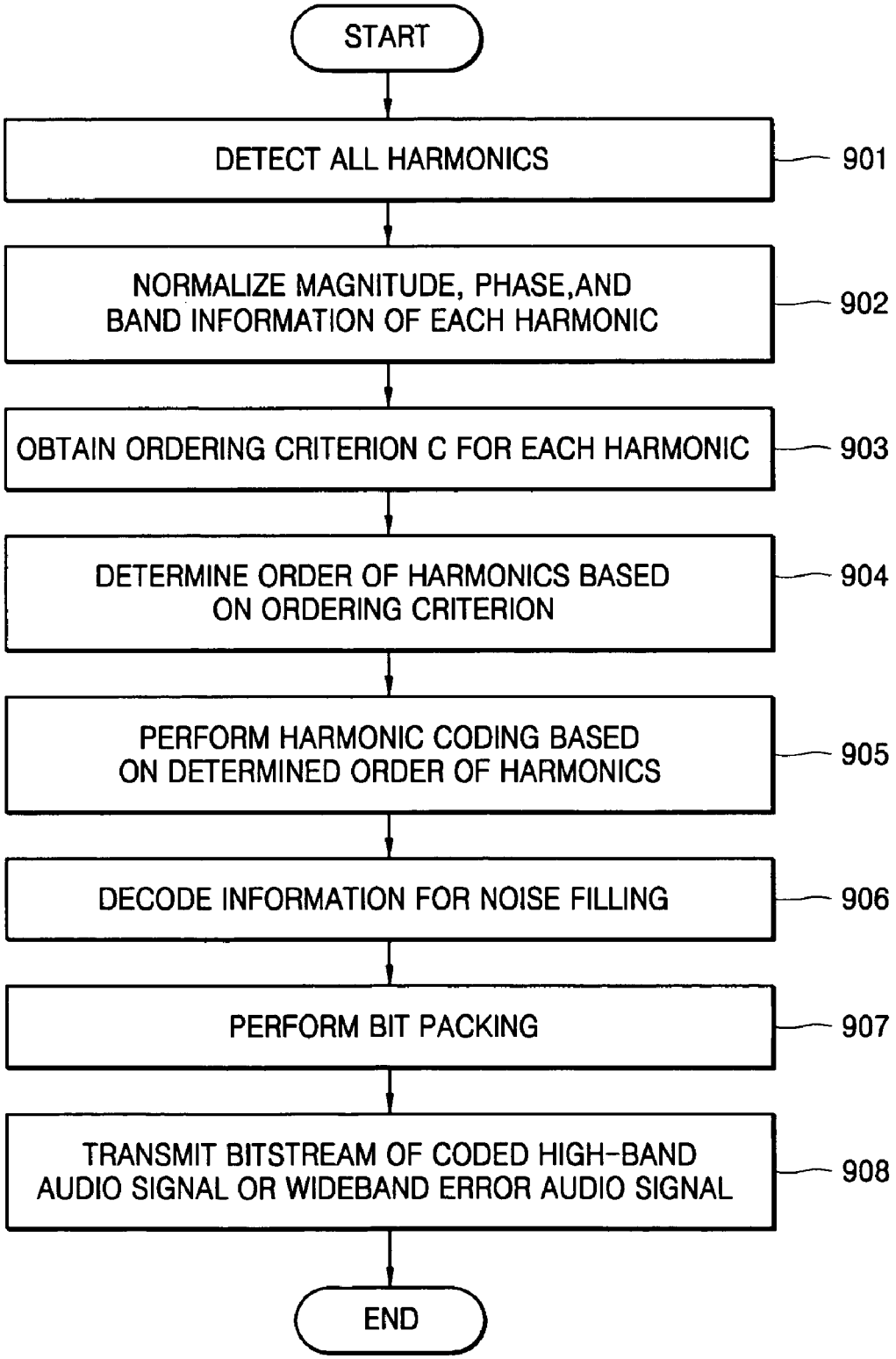
FIG. 9 is a flowchart illustrating a high-band or wideband error audio coding method according to another embodiment of the present invention.

FIG. 9 is a flowchart illustrating a high-band or wideband error audio coding method according to another embodiment of the present invention.

First, in operation 901, if the inputted audio signal is divided into a high-band audio signal or wideband error audio signal and a low-band audio signal using the band divider 401 shown in FIG. 4, all harmonics of the high-band or wideband error audio signal are detected in each frame. In this case, the number of detected harmonics can be restricted as described above with reference to FIG. 5. In addition, a smoothing method can be applied to the detected harmonics.

In operation 902, the magnitude, phase, and band information of each of the detected harmonics are obtained and normalized. In operation 903, an ordering criterion C of each harmonic is obtained using weighting values, the normalized magnitude, the normalized phase, and the normalized band information corresponding to the magnitude, phase, and band information of each of the detected harmonics.

In operation 904, the order of the harmonics detected in each frame IS determined based on the ordering criterion C. In operation 905, harmonic coding is performed based on the determined order of the harmonics. The harmonic coding is performed on the harmonics sequentially in order of ordering criterion.

In operation 906, information required for noise filling is decoded.

In operation 907, bit packing is performed on the high-band audio signal or wideband error audio signal using the harmonic coding result and the coded information for noise filling, and a bitstream shown in FIG. 7 is generated.

In operation 908, the generated bitstream is transmitted to the channel 410 as a bitstream of the coded high-band audio signal or wideband error audio signal.

Figure 10:
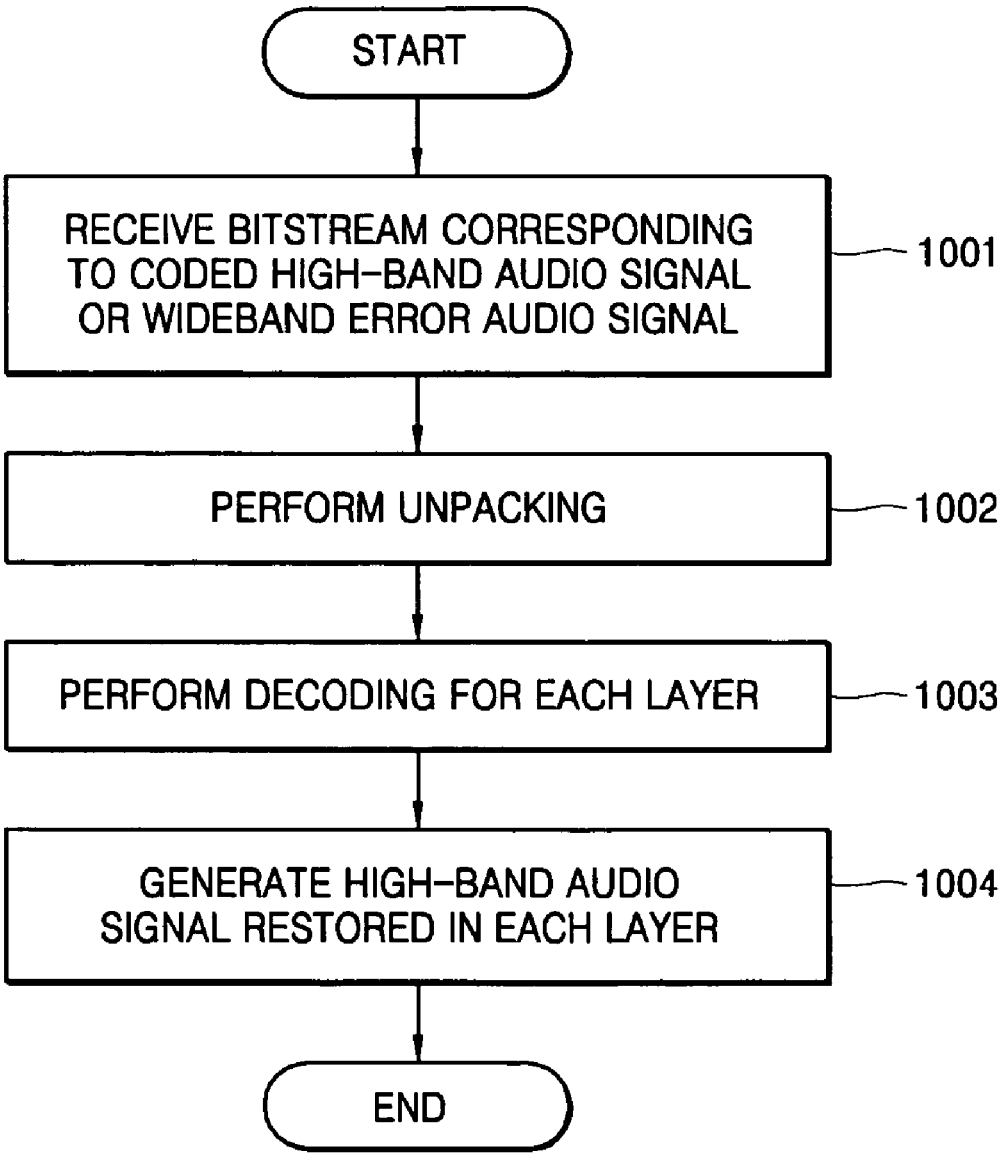
FIG. 10 is a flowchart illustrating a high-band or wideband error audio decoding method according to another embodiment of the present invention.

FIG. 10 is a flowchart illustrating a high-band or wideband error audio decoding method according to another embodiment of the present invention.

A bitstream corresponding to a coded high-band audio signal or wideband error audio signal is received in operation 1001, and the received bitstream is unpacked and divided according to layers and harmonics in operation 1002. In operation 1003, the bitstream divided according to layers and harmonics is decoded as described above with reference to FIG. 8, and in operation 1004, a high-band audio signal or wideband error audio signal restored in each layer is generated.

The methods according to the above-described embodiments of the present invention can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices. The computer readable recording medium can also be distributed over network coupled computer systems so that the computer readable code is stored and executed in a distributed fashion.

According to the above-described embodiments of the present invention, fine granularity scalability is supported using harmonic information of a high-band audio signal or wideband error audio signal such that scalability of the audio signal is maximized, decoding is performed in harmonic units and very fine granularity scalability is supported.

In addition, a low-band audio signal is maintained and harmonic information regarding the high-band audio signal or wideband error audio signal is used such that the quality of a basic audio signal is maintained.

Since an audio signal can be restored through noise filling even in harmonics of the high-band or wideband error audio signal having very small amplitudes, the quality of the audio signal can be improved.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. An audio coding method comprising:

detecting harmonics of a high-band audio signal or wideband error audio signal of an input audio signal;

determining an order of the detected harmonics; and coding the detected harmonics based on the determined order of the detected harmonics, wherein the determining an order of the detected harmonics comprises:

normalizing magnitude, phase, and band information for each of the detected harmonics;

obtaining an ordering criterion C for each of the detected harmonics based on the normalized magnitude M, phase P, band information B, and predetermined weighted values $W_m$, $W_p$, $W_b$, according to an Equation $C=MW_m+PW_p+BW_b$; and determining the order of the detected harmonics based on the ordering criterion for each detected harmonic.

2. The audio coding method of claim 1, further comprising coding information required for noise filling.

3. The audio coding method of claim 2, wherein the information required for noise filling includes a root mean square (RMS) of magnitudes of detected harmonics for each frame and tilt information of a spectrum.

4. The audio coding method of claim 2, further comprising performing bit packing using the coded harmonics and the coded information required for noise filling.

5. The audio coding method of claim 4, wherein the bit packing comprises generating a bitstream including a core layer including the information required for noise filling and an enhancement layer including the coded harmonics for each of the detected harmonics.

6. The audio coding method of claim 1, wherein the harmonic coding is performed sequentially from the detected harmonic having the highest ordering criterion to the detected harmonic having the lowest ordering criterion.

7. The audio coding method of claim 1, wherein the detecting harmonics comprises:

detecting all of the harmonics of the high-band audio signal or wideband error audio signal for each of the frames; and removing detected harmonics having magnitudes less than or equal to a predetermined value.

8. The audio coding method of claim 1, wherein magnitudes of harmonics are normalized based on a corresponding largest amplitude, the band of harmonics are normalized by setting a corresponding lowest band to 1 and highest band to 0 in an input audio signal and interpolating remaining bands within a numerical range 1-0, and phases of the harmonics are normalized in a range from $-\pi$to $\pi$ by setting an absolute value to $\pi$.

9. At least one non-transitory computer readable recording medium comprising computer readable code to control at least one processing device to implement the method of claim 1.

10. An audio coding apparatus included with and using a computer system, including at least one processing device, comprising:

a harmonic detecting unit detecting harmonics of a high-band audio signal or wideband error audio signal of an input audio signal;

a harmonic order determining unit determining an order of the detected harmonics; and a harmonic coding unit coding the harmonics based on the determined order of the detected harmonics, wherein the harmonic order determining unit normalizes magnitude, phase, and band information for each of the detected harmonics, obtains an ordering criterion C for each of the detected harmonics and determines the order of the detected harmonics based on the ordering criterion C, wherein the ordering criterion C of the detected harmonics are obtained based on the normalized magnitude M, phase P, band information B, and predetermined weighted values $W_m$, $W_p$, $W_b$, according to an Equation $C=MW_m+PW_p+BW_b$.

11. The audio coding apparatus of claim 10, wherein the harmonic coding unit further codes information required for noise filling.

12. The audio coding apparatus of claim 11, wherein the information required for noise filling includes a root mean square (RMS) of magnitudes of detected harmonics for each frame and tilt information of a spectrum.

13. The audio coding apparatus of claim 11, further comprising a bit packing unit bit packing the coded harmonics to generate a bitstream including a core layer including the information required for noise filling and an enhancement layer including the coded harmonics for each of the detected harmonics.

14. The audio coding apparatus of claim 10, wherein the harmonic detecting unit detects all of the harmonics of the high-band audio signal or wideband error audio signal for each frame, removes the harmonics having magnitudes less than or equal to a predetermined value, and outputs the remaining harmonics as detected harmonics.

15. The audio coding apparatus of claim 10, further comprising:

a band divider dividing the input audio signal into a high-band audio signal or wideband error audio signal and a low-band audio signal; and a low-band audio coding unit coding the low-band audio signal and providing the coded low-band audio signal to the band divider.

16. The audio coding apparatus of claim 10, wherein the harmonic order determining unit normalizes magnitudes of harmonics based on a corresponding largest amplitude, the band of harmonics are normalized by setting a corresponding lowest band to 1 and highest band to 0 in an input audio signal and interpolating remaining bands within a numerical range 1-0, and phases of the harmonics are normalized in a range from $-\pi$ to $\pi$ by setting an absolute value to $\pi$.

17. An audio decoding method comprising:

unpacking a received bitstream and dividing the unpacked bitstream for each layer, wherein the layers are a core layer and an enhancement layer and the enhancement layer is divided into harmonics of a coded high-band audio signal or wideband error audio signal;

decoding the unpacked bitstream corresponding to the coded high-band audio signal or wideband error audio signal for each layer of the received bitstream;

determining whether a determined number of harmonics of the received bitstream included in the enhancement layer is less than or equal to a threshold value;

restoring the high-band audio signal or the wideband error audio signal using information required for noise filling included in the core layer based upon the determining indicating that the determined number of harmonics of the received bitstream included in the enhancement layer is less than or equal to the threshold value; and outputting a decoded result for each layer as a high-band audio signal or wideband error audio signal restored in each layer.

18. The audio decoding method of claim 17, wherein the threshold value is based on noise filling information obtained during encoding of a high-band audio signal or wideband error audio signal of an input audio signal.

19. The audio decoding method of claim 18, wherein the information required for noise filling is based on a root mean square of harmonics used in the encoding of the coded high-band audio signal or wideband error audio signal.

20. At least one non-transitory computer readable recording medium comprising computer readable code to control at least one processing device to implement the method of claim 17.

21. An audio decoding method comprising:

decoding a received bitstream corresponding to a coded high-band audio signal or wideband error audio signal for each layer of the received bitstream;

outputting a decoded result for each layer as a high-band audio signal or wideband error audio signal restored in each layer; and unpacking the received bitstream and dividing the unpacked bitstream for each layer, wherein the layers are a core layer and an enhancement layer and the enhancement layer is divided into harmonics of the coded high-band audio signal or the wideband error audio signal, and wherein, when a number of harmonics of the received bitstream included in the enhancement layer is less than or equal to a predetermined value, the high-band audio signal or wideband error audio signal is restored using information required for noise filling included in the core layer, wherein the predetermined value is set based on a ratio of a sum of magnitudes of all of decoded harmonics to a total root mean square.

22. At least one non-transitory computer readable recording medium comprising computer readable code to control at least one processing device to implement the method of claim 21.

23. An audio decoding method comprising:

unpacking a received bitstream and dividing the unpacked bitstream for each layer, wherein the layers are a core layer and an enhancement layer and the enhancement layer is divided into harmonics of a coded high-band audio signal or a wideband error audio signal;

decoding the unpacked bitstream corresponding to the coded high-band audio signal or wideband error audio signal for each layer of the received bitstream;

outputting a decoded result for each layer as a high-band audio signal or wideband error audio signal restored in each layer, wherein, when a number of harmonics of the received bitstream included in the enhancement layer is less than or equal to a threshold value, the high-band audio signal or wideband error audio signal is restored using information required for noise filling included in the core layer, and wherein the threshold value is based on a comparison of decoded harmonics and the information required for the noise filling, with the information required for the noise filling being information regarding noise filling information obtained during encoding of a high-band audio signal or wideband error audio signal of an input audio signal.

24. The audio decoding method of claim 23, wherein the information required for noise filling includes a root mean square of harmonics used in the encoding of the coded high-band audio signal or wideband error audio signal.

25. At least one non-transitory computer readable recording medium comprising computer readable code to control at least one processing device to implement the method of claim 23.

26. An audio decoding method comprising:

unpacking a received bitstream and dividing the unpacked bitstream for each layer, wherein the layers are a core layer and an enhancement layer and the enhancement layer is divided into harmonics of a coded high-band audio signal or wideband error audio signal;

decoding the received bitstream corresponding to the coded high-band audio signal or wideband error audio signal for each layer of the bitstream; and outputting a decoded result for each layer as a high-band audio signal or wideband error audio signal restored in each layer;

wherein, when a number of harmonics of the received bitstream included in the enhancement layer is less than or equal to a threshold value, the high-band audio signal or wideband error audio signal is restored using information required for noise filling included in the core layer, and the high-band audio signal or wideband error audio signal is restored without the noise filling otherwise.

27. The audio decoding method of claim 26, wherein the threshold value is based on noise filling information obtained during encoding of a high-band audio signal or wideband error audio signal of an input audio signal.

28. The audio decoding method of claim 27, wherein the information required for noise filling includes a root mean square of harmonics used in the encoding of the coded high-band audio signal or wideband error audio signal.

29. At least one non-transitory computer readable recording medium comprising computer readable code to control at least one processing device to implement the method of claim 26.

* * * * *

UNITED STATES PATENT AND TRADEMARK OFFICE

CERTIFICATE OF CORRECTION

PATENT NO. : 8,015,017 B2
APPLICATION NO. : 11/337487
DATED : September 6, 2011
INVENTOR(S) : Sung et al.

It is certified that error appears in the above-identified patent and that said Letters Patent is hereby corrected as shown below:

Column 9, Line 52, In Claim 8, delete "πto" and insert -- -π to --, therefor.

Column 12, Line 29, In Claim 26, before "bitstream" insert -- received --.

Column 12, Line 32, In Claim 26, delete "layer;" and insert -- layer, --, therefor.

Signed and Sealed this
Fourteenth Day of February, 2012

David J. Kappos

David J. Kappos
*Director of the United States Patent and Trademark Office*